US006533575B2

(12) United States Patent
Man

(10) Patent No.: US 6,533,575 B2
(45) Date of Patent: Mar. 18, 2003

(54) LIGHTER WITH A FLIPPER SAFETY MECHANISM

(76) Inventor: Aman Chung Kai Man, Wah Lai Ind. Centre, Unit 1, 11/F, 10-14 /Kwei Tei, Fo Tan Shatin (CN)

( * ) Notice: Subject to any disclaimer, the term of this patent is extended or adjusted under 35 U.S.C. 154(b) by 0 days.

(21) Appl. No.: 10/060,177

(22) Filed: Jan. 29, 2002

(65) Prior Publication Data

US 2002/0076667 A1 Jun. 20, 2002

Related U.S. Application Data

(63) Continuation-in-part of application No. PCT/FR00/03128, filed on Nov. 9, 2000.

(51) Int. Cl.[7] ..... F23Q 2/28; F23Q 2/00; F23D 11/36

(52) U.S. Cl. ..... 431/153; 431/255

(58) Field of Search ..... 431/153, 255, 431/277; 222/153.13, 153.14, 153.01, 402.11

(56) References Cited

U.S. PATENT DOCUMENTS

| | | | |
|---|---|---|---|
| 3,719,447 | A | 3/1973 | Dessoy |
| 3,749,286 | A | 7/1973 | Douglas |
| 4,784,602 | A | 11/1988 | Nitta |
| 5,145,358 | A | 9/1992 | Shike |
| 5,310,336 | A | 5/1994 | Segawa |
| 5,334,011 | A | 8/1994 | Frigiere |
| 5,427,522 | A | 6/1995 | McDonough |
| 5,462,432 | A | 10/1995 | Kim |
| 5,492,468 | A | 2/1996 | Cirami |
| 5,531,591 | A | 7/1996 | Yamazaki |
| 5,829,963 | A | 11/1998 | Ichikawa |
| 5,833,448 | A | 11/1998 | Doucet |
| 5,839,892 | A | 11/1998 | Hwang |
| 5,885,069 | A | 3/1999 | Rogelet |
| 5,997,282 | A | 12/1999 | Man |
| 6,039,561 | A | 3/2000 | Lei |
| 6,077,070 | A | 6/2000 | Doucet |
| 6,086,358 | A | 7/2000 | Potskhishvilli |
| 6,095,796 | A | 8/2000 | Sung |
| 6,116,892 | A | 9/2000 | Yang |
| 6,129,544 | A | 10/2000 | Chen |
| 6,135,761 | A | 10/2000 | Chen |
| 6,142,767 | A | 11/2000 | Chan |
| 6,146,129 | A | 11/2000 | Li |
| 6,206,689 | B1 | 3/2001 | Doucet |
| 6,213,759 | B1 | 4/2001 | Sung |
| 6,287,109 | B1 | 9/2001 | Hirota |

FOREIGN PATENT DOCUMENTS

| | | |
|---|---|---|
| WO | WO 9946539 | 9/1999 |

*Primary Examiner*—Carl D. Price
(74) *Attorney, Agent, or Firm*—Trojan Law Offices

(57) ABSTRACT

The invention concerns a piezo lighter incorporating a child safety mechanism. The mechanism relates to an activation button and a flipper, which is either pivotally secured or integrally formed with the activation button. The safety mechanism includes a stopper on the activation button, which limits the downward movement of the activation button. The activation button translates downward sufficiently to operate the fuel-release lever opening the fuel-discharge valve. However, in order to activate the piezo-electric unit, the flipper must also be depressed a further distance than the activation button and rotated about a button axis to generate a spark to ignite the fuel released by the fuel-release lever and fuel-discharge valve.

6 Claims, 10 Drawing Sheets

F1
F2
A
B
ZZ'
XX'
90
92
92a
92b
94
96
98
100
100a
100b
100c
101
101a
102
103
103a
104
105a
105b
106
108
110
111
112
118
119
119a
120
122
124
126
128
132
14

LIGHTER WITH A FLIPPER SAFETY MECHANISM

PRIORITY INFORMATION

Pursuant to 35 U.S.C. §120 and §365(c), this is a continuation-in-part of PCT/FR00/03128, filed Nov. 9, 2000, which claims priority to French Patent Application No. 99/14153, filed Nov. 10, 1999. PCT/FR00/03128 was published in French on May 17, 2001 as WO 01/35026.

BACKGROUND OF THE INVENTION

1. Field of Invention

This invention relates generally to child resistant lighters with a flipper safety mechanism.

2. Related Art

The invention relates to a lighter comprising, on the one hand, a flame generation device whereof a portion called an actuator is mobile between a so-called rest position, wherein said device cannot generate a flame, and a so-called ready position wherein said device can generate a flame, and on the other hand, a safety mechanism mobile between a so-called locked position wherein said safety mechanism blocks the actuator in its rest position and a so-called unlocked position enabling said actuator to move towards its active position.

In this type of lighter, a safety mechanism is present to prevent unintended persons, such as children, from using the lighter and igniting a flame, thereby risking injury to themselves or to other persons.

A lighter of the type described above wherein the safety mechanism is a safety member cooperating with a blocking ridge integral with the lighter when the safety mechanism is in its locked position, is shown in U.S. Pat. No. 5,145,358.

To go from the locked position to the unlocked position when the lighter is placed in a vertical position, the user must cause horizontal movement of the safety member, thereby releasing it from the blocking ridge, and at the end of its movement, must depress the actuator vertically to initiate the generation of a flame.

A lighter comprising a flame generation device and a safety mechanism is also shown in U.S. Pat. No. 5,833,448.

The flame generation device comprises a portion called an actuator, which is mobile between a rest position wherein the device cannot generate a flame and a so-called ready position wherein the device can generate a flame.

The safety mechanism of this lighter is an integral part of the actuator and has a projecting portion, which cooperates with a blocking ridge of the lighter in order to block the actuator when it is subjected to a conventional force, which any user employs to operate the lighter.

This force is aligned with an axis corresponding to that of the actuator.

The teaching of this patent indicates that to release the actuator, it must be titled rearward and hence, simultaneously, the safety mechanism attached thereto, in order to release the projecting portion of the safety mechanism from the blocking ridge of the lighter.

An axial thrust force must then be applied in a known manner to the actuator to operate the lighter.

In the view of the documents cited above, the applicant aims to find a new lighter striking a good compromise between its user-friendliness for a normal user and its difficulty of use by an unintended user.

The present invention therefore proposes a lighter comprising, on the one hand, a flame generation device whereof a portion called an actuator is mobile between a so-called rest position, wherein said device cannot generate a flame, and a so-called ready position, wherein said device can generate a flame and, on the other hand, a safety mechanism mobile between a so-called locked position wherein said safety mechanism blocks the actuator in its rest position and a so-called unlocked position enabling said actuator to move toward its ready position, wherein the safety mechanism pivots about the actuator to change position.

The present invention hence proposes a lighter safety mechanism of a novel design.

The lighter safety mechanism according to the invention offers the advantage of being simpler to use than that of the lighter described in U.S. Pat. No. 5,833,448 because it only provides for the pivoting motion of the safety mechanism about the actuator, and not the movement of the entire actuator, as in the patent cited.

According to one feature of the invention, the safety mechanism comprises a so-called bearing portion, which under the action of a first force makes a pivoting motion towards one end of the actuator to which a second force is applied to displace said actuator from its rest position towards its ready position, said bearing portion being arranged at the level of said end when the safety mechanism is in the unlocked position.

Thus, when the safety mechanism has been displaced from its locked position to its unlocked position by applying the first force, the bearing portion being disposed at the level of the end of the actuator, the user then merely needs to apply the second-force naturally to displace the actuator from its end, from its rest position to its ready position.

At the end of the pivoting motion, when the safety mechanism is in the unlocked position, the first force is applied to the bearing portion in a direction forming an angle greater than 90 degrees to another direction along which the second force is applied to the end of the actuator.

Thus, at the end of the unlocking movement of the safety mechanism, the force applied by the user to terminate this movement is not, as described in U.S. Pat. No. 5,145,358, perpendicular to the other direction along which the second force is applied to the end of the actuator to conventionally operate the lighter, but, on the contrary, makes an angle greater than 90 degrees to it, thereby facilitating the sequencing of the two movements and naturally guiding the user in the second movement.

Furthermore, the pivoting motion of the safety mechanism proposed according to the invention is more difficult to achieve for an unintended user of the lighter than a simple transition motion, as provided in the lighter of U.S. Pat. No. 5,145,358.

In fact, an unintended user such as a child could inadvertently use the lighter of U.S. Pat. No. 5,145,358 by pressing its finger at different places on the grooved portion of the end of the actuator, which is a non-negligible surface area if the force it applies to this portion is unintentionally oblique and not perpendicular thereto.

On the contrary, to cause a pivoting motion of the safety mechanism of the lighter according to the invention, it is necessary, by definition, to pivot this mechanism and thereby to locate the pivot about which the movement is made.

Such movement is hence theoretically more difficult to execute than a simple translation motion and, in all likelihood, a pivoting motion is more rarely applied unintentionally than a translation motion similar to the one described herein.

According to one characteristic, the pivoting motion is executed about an axis.

According to one characteristic, the actuator is mobile along a longitudinal axis.

According to one characteristic, the safety mechanism pivots about an axis perpendicular to the longitudinal axis of movement of the actuator.

According to one characteristic, the safety mechanism is elastically maintained in its locked position.

According to one characteristic, the safety mechanism comprises a safety member cooperating with a blocking ridge integral with said lighter.

According to another characteristic, the safety member comprises a so-called ready portion, which is disposed against the blocking ridge, in the locked position of the safety mechanism, and which is disposed facing a housing, in the unlocked position of said safety mechanism.

According to one characteristic, in the locked position of the safety mechanism, the active portion is tilted to the longitudinal axis of the actuator in the direction of said actuator.

According to another characteristic, the safety member comprises a bearing portion whereof the pivoting motion has an amplitude corresponding to the tilt angle formed between the active portion and the longitudinal axis of the actuator.

According to one characteristic, the housing is elongated along an axis parallel to the longitudinal axis of displacement of the actuator so that, in the locked position of the safety mechanism, the active portion of the safety member engages in said housing when the actuator goes from its rest position to its ready position.

According to another characteristic, the active portion of the safety members forms a flange.

According to one characteristic, the actuator comprises a cap to which pressure is applied to displace said actuator from its rest position towards its ready position, the safety member being arranged at the level of said cap.

According to a first and second embodiment of the invention, the safety member forms at least one member added to the actuator.

Advantageously, the addition of a safety member to the actuator does not put into question the entire design of said actuator.

According to a characteristic of the first and second embodiment, the safety member is fixed to the actuator via its pivoting axis.

This represents a particularly simple and effective means to fix the safety member.

According to a characteristic linked to the first and second embodiments of the invention, the safety member comprises the bearing portion, which is arranged around the pivoting axis.

According to a characteristic linked to the first two embodiments of the invention, the flange of the safety member is attached to the bearing portion.

According to a characteristic linked to the first two embodiments, the safety member comprises an inactive portion, which is maintained in position with respect to the actuator.

The inactive portion does not participate in the pivoting motion of the safety member but, on the contrary, serves as a support point for said member during the pivoting motion and thereby limits the amplitude of said motion. The inactive portion is for example, blocked by the actuator.

According to a characteristic of the first embodiment of the invention, the safety member comprises a spring having, on the one hand, a so-called central portion arranged inside the bearing portion of said member and around the pivoting axis and, on the other hand, two so-called end portions, one extending along the flange and the second merging with the inactive portion maintained in position with respect to the actuator.

This serves to obtain a limited elastic deformation of the safety member during the pivoting motion.

According to a characteristic of the second embodiment, the inactive portion maintained in position with respect to the actuator is a flange, which has a reduced thickness compared with the thickness of the bearing portion of the safety member.

This also serves to obtain a limited elastic deformation of said safety member during the pivoting motion.

According to a characteristic linked to the first two embodiments, the active and inactive portions of the safety member form between one another an angle smaller than 90° when the safety mechanism is in the locked position.

According to another characteristic of the first two embodiments of the invention, the bearing portion of the safety mechanism is grooved and/or embossed to facilitate its use by a lighter user.

According to a third embodiment of the invention, the safety member forms one and the same member with the actuator.

In particular, the safety member forms one and the same member with the cap, which does not require reviewing the entire design of the actuator.

According to a characteristic linked to the third embodiment, the safety member is integral with the actuator via an arm.

According to one characteristic, this arm has a general curved shape, which acts as a hinge for the pivoting motion of the safety member.

According to a characteristic linked to this third embodiment, the pivoting axis is placed at the level of the arm.

According to another characteristic linked to this third embodiment, the safety member comprises, on the one hand, an actuating head at least partially forming the bearing portion to which the force is applied to execute the pivoting motion and, on the other hand, the flange forming the active portion of said member.

In particular, the actuating head and flange confer on the safety member a general T-shape with a leg that is formed of said flange.

According to another characteristic linked to this third embodiment of the invention, a space is provided between the actuating head and the actuator.

This space enables said actuating head to be displaced during the pivoting motion of the safety member towards its unlocked position, while limiting said displacement.

These and other objects, features and advantages of the invention will become more readily apparent from the following detailed description, which is given as an illustrative, not limitative example and should be read in conjunction with the accompanying drawings.

In addition, lighters containing piezoelectric units are very useful and have become quite prevalent in modern times. Lighters of the type described herein generally contain a lighter housing that is small enough to be held in the palm of an adult hand. The operation of piezoelectric lighters is somewhat simpler than that of the traditional flint/spark-wheel lighter. Generally, the lighter is operated by depressing an actuator button, which both activates the piezoelectric unit and acts on a fuel-release lever to release fuel. As a result, a flame is produced at a location opposite the actuator button. As is evident, this process avoids the need for operation of a spark wheel simultaneously with operation of a fuel-release button in order to generate a flame. Obviously, there is an advantage to the simplicity that is offered by piezoelectric lighters. On the other hand, in the hands of children, or others who do not know how to safely and properly operate the lighter, such lighters are as dangerous as any other spark and/or flame-producing device. Therefore, a need has been realized to equip lighters with safety features that minimize accidental or improper use by inexperienced persons, especially young children.

Many inventions have been created to address this safety-related concern. Generally, these inventions have sought to introduce safety mechanisms that disable operation of the actuator button of the lighter. As such, these lighters normally consist of a safety feature whereby the operational path of the actuator button is blocked by a latch, button, slide, or other blocking means. Proper operation of the lighter requires that the blocking means be moved out of the path of the actuator button, or other structure that might be integral with the actuator button, before a flame can be produced. Only then is the operator able to depress the actuator button and produce a flame. As such, the prior art requires additional structural members, as well as additional steps (e.g., lateral or longitudinal disengagement of a blocking means), to operate the lighter.

In some of the aforementioned lighters, the safety mechanism is passive. That is, once the safety feature is deactivated by moving the blocking member from the "locked" to the "unlocked" position, the lighter remains in the "unlocked" position, and thus is operable as a cigarette lighter with no safety feature at all. In these devices, the lighter remains in the "unlocked" position until the safety feature is activated again by manually reengaging the safety mechanism (e.g., by manually returning the blocking means to the "locked" position).

In order to address this problem, some inventions have introduced safety mechanisms that are activated automatically after each use of the lighter. In general, this improvement has alleviated some of the fears associated with leaving the lighter in an "unlocked", operable position after the operator has finished using the lighter. Nevertheless, a disadvantage that is common to the passive, as well as the active, lighters is that their operation is usually quite cumbersome. Frequently, in order to use such lighters, the operator must use more than one finger, and sometimes more than one hand, to perform several functions simultaneously. As such, loss of ease of use is the price that is paid for any additional amount of safety that might be achieved.

Therefore, there is a need for a device that not only achieves the stated safety goals, but also is amenable to operation with relative ease. The invention described herein offers such a combination and consists of a safety button that is similar in size and physical location to the conventional activation button. The invention requires that a flipper or piezo ignition button, located in a cavity within the activation button, be depressed simultaneously with the activation button before a flame can be produced. In this way, young children are coaxed into believing that they can operate the lighter in the usual way, i.e., by pressing only the activation button. However, such operation will produce neither a spark nor a flame. Moreover, given the relatively small size of the flipper, operation of this button requires an amount of strength and pulp that are rarely found in the fingers of young children. At the same time, due to the placement of the flipper, simultaneous operation of both the activation button and the flipper requires use of only one finger, so that operation of the lighter by the intended adult user is no different from operation of a lighter with no safety mechanism at all.

SUMMARY OF THE INVENTION

The primary object of this invention is to provide a safety mechanism for child-resistant lighters so that children, or inexperienced users, will be less likely to inadvertently activate the lighter. Such a safety feature is especially important because young children often play with lighters as toys and because lighters have mechanically moveable parts that make them attractive to children as toys.

A second object of the present invention is to provide an improved device for maximizing safety in lighters without compromising ease of use.

The invention meets its objectives by providing an activation button and a flipper within one button. When a child attempts to activate the lighter by depressing the activation button, neither a spark or a flame will be generated because the activation button is stopped along its path by a stopper before activating the piezo unit to generate a spark.

The stopper is integral with the activation button, and when the activation button is depressed, this stopper engages a ledge on the inner surface of the lighter housing, so that the activation button cannot continue to activate the piezo unit to generate a spark. As such, repeated operation of the activation button by a child will yield the same unsuccessful results.

The only way to activate the lighter is to depress the flipper with the activation button. When this is done, initially, the activation button and the flipper will both move a certain distance, say distance Y, along the longitudinal axis of the lighter. But, when the stopper of the activation button engages the ledge of the inner surface of the lighter body, the activation button cannot move any further than distance Y. Depressing the activation button may only release some fuel, but without activating the piezo unit, no spark is produced to ignite this fuel.

However, if the user continues to depress the flipper, the flipper moves a distance, say distance Z, further than the activation button to activate the piezo unit to generate a spark to ignite the released fuel. Since the flipper is pivotally connected or integrally connected to the activation button about a button axis, the flipper can move independently of the activation button.

This is a simple, yet effective concept. Nevertheless, it is a concept that a young child operating the lighter must recognize and grasp before he/she can successfully operate the lighter. In most cases, the child will not recognize the usefulness of the flipper and will abandon the lighter after several unsuccessful attempts.

Moreover, even if a child does attain an appreciation for the interrelationship between the flipper, the activation button, and the production of a flame, he/she will still have difficulty activating the lighter. The portion of the flipper that is exposed is small relative to the size of the activation button. As such, it is more difficult to fully depress the flipper than if the operator needed to depress only the larger, more-easily reachable, activation button. Thus, the single finger of a young child will not be able to fully depress the flipper. Moreover, because of the smaller size and location of the flipper, a child cannot use a plurality of fingers to try and depress the flipper. As such, the strength needed to depress the flipper, and the lack thereof in young children, itself acts as a deterrent in the present invention.

Furthermore, in order for the lighter to be successfully operated, the user must continue to press the flipper in order to activate the piezo unit to generate a spark. In order to achieve this task, the operator's finger must have enough pulp to continue to depress the flipper even when the activation button has stopped. While an adult operator can easily perform this procedure, a child operator will have difficulty doing so. Hence, again, the structural configuration of the safety mechanism of the present invention acts as a deterrent to use by young children.

Finally, as can be understood from the above description, the invention disclosed herein achieves its safety objectives without making operation of the lighter any more cumbersome than a conventional piezoelectric cigarette lighter with no safety feature. Specifically, the flipper is shaped and positioned in such a way that operation of the lighter is very simple in experienced hands. An adult user familiar with the operation of lighters need use only one finger and activate the lighter as he/she would normally by placing the finger on the flipper and activation button. This allows the user to operate the lighter in a safe, yet non-complicated manner.

This and other advantages of the present invention will become more apparent through the following description of the drawings and detailed description of the preferred embodiment.

DETAILED DESCRIPTION OF THE PREFERRED EMBODIMENT

Figure 1:
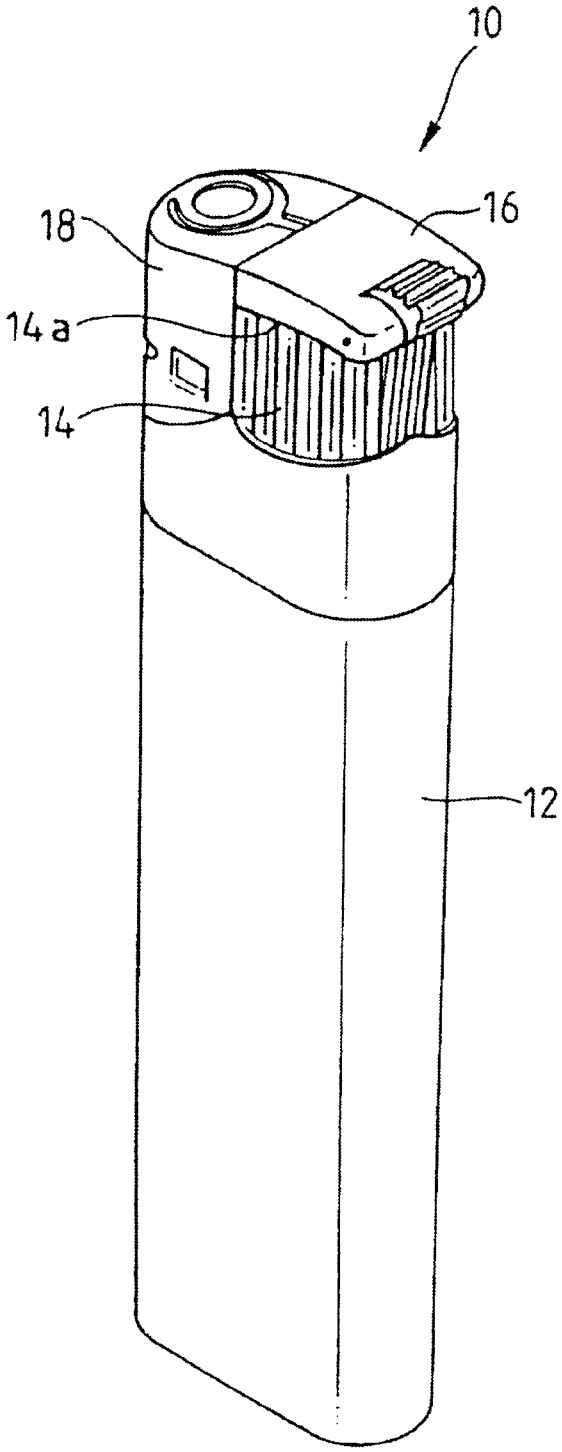
FIG. 1 is a perspective view of a lighter according to the present invention.

Referring to FIG. 1 and denoted by the general numeral 10, a lighter according to the invention comprises a body 12 of general elongated form, a flame generation device comprising an actuator 14 whereof only one portion is shown in this figure.

The portion of the actuator shown in FIG. 1 represents an end 14*a* of said actuator, which is provided with a cap 16 whereto the user of the lighter must apply a downward pressure, along the longitudinal axis of the lighter ZZ', to displace the actuator within the body 12.

The lighter also comprises a member 18 forming a wind guard to protect the flame generated by the lighter.

Figure 2A:
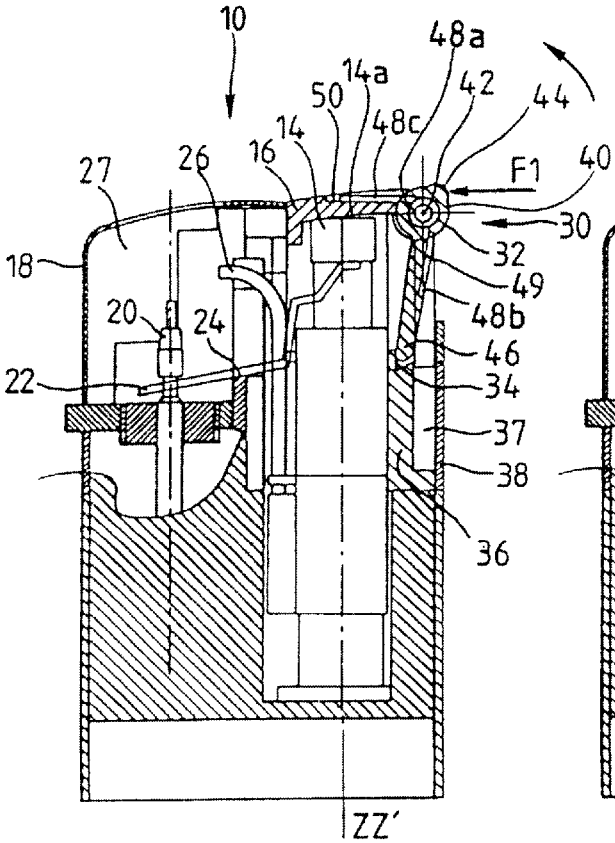
FIG. 2*a* is a partial cross-sectional view of a lighter according to a first embodiment of the invention, in a first position.

The lighter in FIG. 1 is partially shown in a schematic cross sectional view in FIG. 2*a*.

As stated above, the lighter comprises a flame generation device, which is known to one skilled in the art and which comprises in particular the body of the actuator 14 equipped at the end 14*a* with cap 16.

This cap is considered as forming part of the actuator.

The flame generation device also comprises a gas jet release member 20, as for example a nozzle connected to a gas filled reservoir and not shown in the figures.

The flame generation device also comprises a member 22 resting on a pivot 24 and forming a lever.

Member 22 has two ends each of which is in contact respectively with the actuator and the gas jet release member.

The lighter of the invention operates according to the known principle of the piezoelectric effect in which a piezoelectric element, such as a crystal, is struck by a member forming a hammer to produce an electric spark.

Figure 2B:
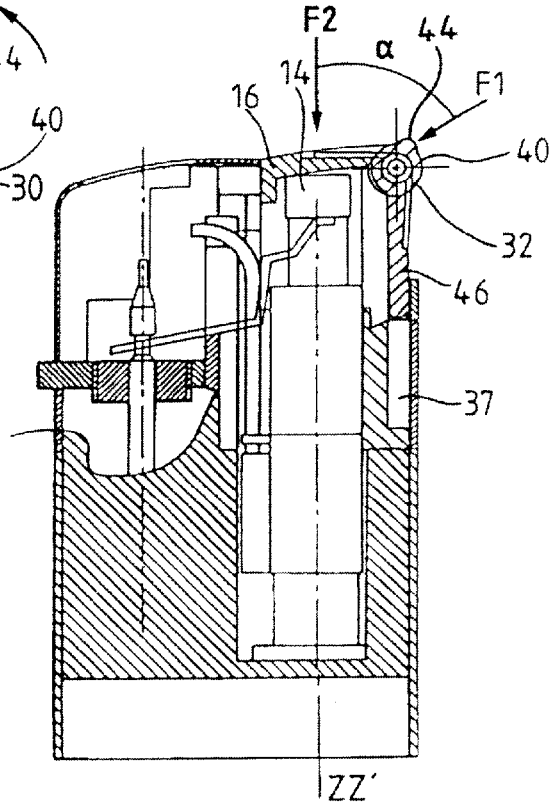
FIG. 2*b* is a view of the lighter of FIG. 2*a* in a second position.
Figure 2C:
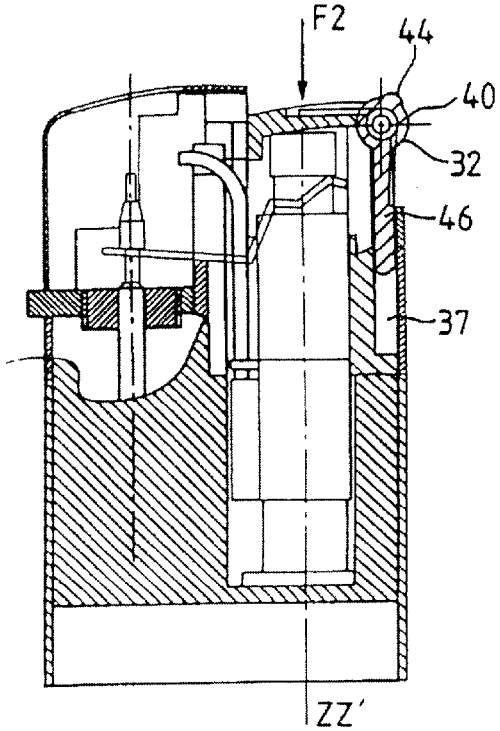
FIG. 2*c* is a view of the lighter of FIG. 2*a* in a third position.

The end of the actuator 14 opposite end 14*a* and which is not shown in the figures forms a hammer, which strikes a piezoelectric element when said actuator is displaced by a pressure applied by the user's finger to cap 16, from a so-called rest position, shown in FIG. 2*a*, wherein the flame generation device cannot generate a flame, to a so-called ready position, shown in FIG. 2*c*, and wherein said device can generate a flame.

The flame generation device further comprises an electrical conductor 26 whereby a spark generated by the aforementioned piezoelectric mechanism is propagated.

The electrical conductor 26 is electrically connected to the piezoelectric mechanism by one of its ends in a known manner.

The electrical conductor 26 terminates at its opposite end in a combustion chamber 27 wherein the aforementioned gas jet release member 20 also terminates.

During the movement of the actuator shown by its extreme position in FIGS. 2*a* and 2*c*, member 22 forming a lever pivots about its support point 24 when the actuator applies a pressure to the end thereof, permitting upward displacement of the nozzle of the gas jet release member and thereby the release of the gas.

As shown in FIG. 2*c*, in the upper position, the nozzle is at the height of the end of the electric conductor 26 via which the spark exits, thereby permitting the generation of a flame.

The above description relates to the three embodiments illustrated in FIGS. 2 to 5 and will therefore not be repeated in the description of each new embodiment.

FIGS. 2*a*, 2*b*, 2*c*, 2*d*, 3*a*, 3*b* and 3*c* more particularly illustrate a first embodiment of a lighter according to the invention.

The lighter according to this first embodiment of the invention comprises a safety mechanism denoted 30 in FIG. 2A, which is mobile between two positions shown respectively in FIGS. 2*a* and 2*b* and to which we shall subsequently return.

The safety mechanism 30 comprises a safety member 32, which cooperates with a blocking ridge 34 integral with the lighter.

The blocking ridge 34 is in the form of a groove made in the upper end of a wall 36 of the lighter along which the actuator 14 is arranged.

This groove has a general V-shape with an upward directed opening and which is slightly titled to the longitudinal direction ZZ' so that one of the sides of the V is aligned with this direction.

The tilt of the V thereby serves to release the safety member from its blocking ridge whenever necessary.

The lighter further comprises a wall 38 visible from the exterior of said lighter, which is arranged facing wall 36 and at some distance therefrom, thereby arranging between said parallel walls a housing, which is elongated along an axis parallel to longitudinal axis ZZ'.

Figure 3A:
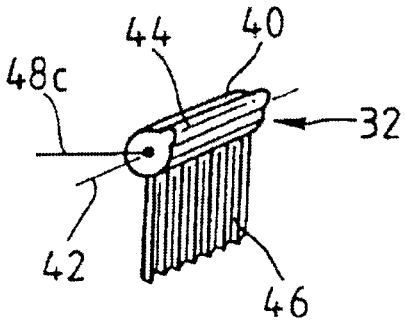
FIG. 3*a* is a view of a safety member used in the lighter of FIG. 2*a* and incorporating a spring.
Figure 3B:
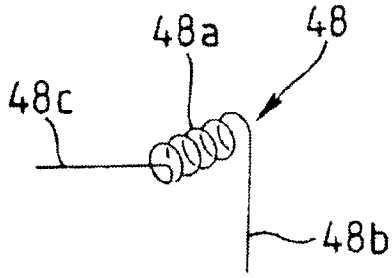
FIG. 3*b* is a view of the spring used in the safety member of FIG. 3*a*.
Figure 3C:
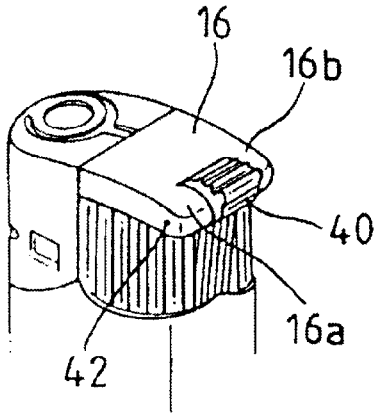
FIG. 3*c* is a partial perspective schematic view of the upper portion of the lighter of FIG. 2*a*.

Safety member 32, which is shown in greater detail in FIGS. 3*a*, 3*b*, and 3*c*, comprises and essentially cylindrical bearing portion 40 which is arranged around a pivoting axis 42.

As shown in FIGS. 2*a* to 2*d*, the bearing portion 40 of the safety member is arranged at the level of the end of actuator 14 and particularly of the cap 16 thereof.

As shown in FIG. 3*c*, cap 16 comprises two arms 16*a* and 16*b* arranging a space between themselves to receive the bearing portion 40 of the safety member.

Arms 16*a* and 16*b* respectively comprise an orifice passing through them to receive axis 42 of the safety member.

This axis 42 acts as a pivoting axis for the movement of the safety member between the positions shown in FIGS. 2*a* and 2*b*.

Axis 42 is arranged perpendicular to longitudinal axes ZZ.

Thus, safety member 32 is fixed to the cap of the actuator via its axis 42.

As shown in FIGS. 2*a* and 3*a*, bearing portion 40 is grooved to facilitate the gripping movement applied by the user of the lighter to this portion.

Furthermore, in addition to the grooves, the bearing portion comprises an embossing 44, which increases the user-friendliness.

However, it must be noted that the simultaneous presence of grooves and embossing or of any other means to facilitate the handling of the safety member by the user is not mandatory, and that a single one of these means can suffice.

As shown in FIGS. 2*a* and 3*a*, the safety member comprises an active portion, which, for example, is in the form of a flange 46 attached to the bearing portion 40 and essentially planar in shape.

When the safety member is in the position shown in FIG. 2*a* corresponding to the locked position of the safety mechanism of the invention, the active portion 46 of the safety member is disposed against blocking ridge 34.

In particular, the safety member comprises a spring 48 shown in FIG. 3*b*, which has a central portion 48*a* shown in the form of a coil spring, and two end portions 48*b* and 48*c* forming the ends of said spring, the end of portion 48*c* being shown in FIG. 3*a*.

The central portion 48*a* of this spring is mounted about the pivot axis 42 inside the bearing portion 40 of the safety member and one of the extreme positions 48*b* of the spring is arranged inside the active portion 46 of the safety member in a recess 49 provided for the purpose, as shown in FIG. 2*a*.

The other end portion 48*c* of the spring forms an inactive portion of the safety member and is arranged inside the cap 16 in a housing 50 provided for the purpose. (FIG. 2*a*)

As shown in FIG. 2*a*, the two end portions 48*b* and 48*c* of spring 48 make an angle smaller than 90° between each other, according to this side view.

The spring thereby applies a torsion force, which resists any action tending to separate its end portions 48*b* and 48*c* from one another to open the angle between them.

When the spring is integrated in the safety member 32, as shown in FIGS. 2*a* and 3*a*, the torsion force applied by this spring forces the active portion 46 to thrust against wall 36, thereby forcing the active portion 46 and inactive portion 48*c* to make an angle smaller than 90° between one another.

The safety mechanism thereby formed, due to the force applied by the spring to the active portion 46 of the safety member 32, is elastically maintained in its locked position shown in FIG. 2*a*.

The safety member thereby formed makes a member, which is added to the actuator.

Thus, the presence of the safety member does not put into question the design of the actuator.

Furthermore, the arrangement of the safety member on the cap of the actuator is extremely simple to achieve.

When the safety mechanism is placed in the locked position, as shown in FIG. 2*a*, the active and inactive portions of safety member 32 form an angle smaller than 90° between one another, which is imposed by the elastic force applied by spring 48 to the active portion 46, thereby bringing it into contact with blocking ridge 34.

In this position, it is impossible for a user to displace actuator 14 by applying a force to cap 16 and hence it is not possible to generate a flame.

An unintended user such as a child, for example, who tries to press on cap 16, therefore cannot succeed in generating a flame in the lighter.

Given the fact that the safety member is in a position which is off-centered in relation to the cap and particularly to the portion of the cap to which the force must be applied to generate a flame, the safety mechanism of the invention is hence more reliable than those of the prior art discussed above.

It has been found that the forces applied to the cap of the lighter to cause its depression and hence to generate a flame are generally applied along longitudinal axis ZZ' or along a direction tilted to said axis.

By following this observation, it proves that the safety mechanism proposed in the lighter described in U.S. Pat. No. 5,145,358 is less reliable than the one of the present invention.

In fact, a force applied by an unintended user such as a child along a direction tilted to the longitudinal displacement axis of the actuator can permit the displacement of the grooved portion arranged on the cap of said actuator and forming a lock, thereby unlocking the safety mechanism.

On the contrary, according to the present invention, the applicant has tilted the active portion 46 of the safety member to the longitudinal axis of the actuator in the direction of said actuator so that, even under the action of a force applied in an oblique direction to longitudinal axis ZZ', the active portion of the safety member remains disposed against blocking ridge 34, thereby maintaining the blocking of the flame generation device.

To unlock the safety mechanism 30 of the invention, it is necessary to pivot safety member 32 about the pivot axis 42 to bring the active portion 46 of said safety member to face the housing 37.

The pivoting motion of the safety member is made independently of the movement of the actuator, which remains immobile during the displacement of said safety member.

The displacement of the safety mechanism from the locked position in FIG. 2*a* to the unlocked position FIG. 2*b* is achieved by the user of the lighter by applying a tangential force to the bearing portion 40 of the safety member 32, in order to rotate it about pivot axis 42, the force being applied towards the cap of the actuator.

The movement applied by the user is facilitated by the presence, on the one hand, of a grooved surface on the bearing portion 40, and on the other, of the embossing 44 of said bearing portion.

As shown in FIG. 2*a*, the thrust force applied by the user is shown by arrow F1, which is initially disposed at least horizontally, the user in fact automatically being able to apply to the bearing portion of safety member 32 a force along a direction forming a slight tilt to the horizontal.

As shown in FIG. 2*b*, when the pivoting motion of the safety member has been completed, the force applied by the user to the bearing portion of said safety member and, in particular, to the embossing 44 thereof, is applied along an axis forming an even greater tilt than previously to the horizontal, thereby facilitating the application of a second force F2 applied along longitudinal direction ZZ' to displace the actuator from its rest position to its ready position, as shown in FIG. 2*c*.

The fact that the directions of application of forces F1 and F2 (FIGS. 2*b* and 3*c*) make an angle alpha between one another greater than 90° further facilitates the sequencing of the two forces.

It should be observed that when the initial force applied by the user to pivot the safety member about its axis is not horizontal but already has a certain tilt to the horizontal, force F1 applied by the user to the safety member, as shown in FIG. 2*b*, makes an even greater angle alpha to the longitudinal direction (axis ZZ') of displacement of the actuator, thereby facilitating the user of the lighter.

As shown in FIG. 2*b* and indicated above, in the unlocked position, the active portion 46 of safety member 32 is disposed facing housing 37 and, under the effect of the second force denoted F2 in FIG. 2*c*, engages with said housing.

It must be observed that the pivoting motion of safety member 32 has amplitude, which corresponds to the angle made by the active portion of said member with the longitudinal displacement axis of the actuator.

The amplitude of this motion is preferably small to avoid making the lighter too difficult to use by the intended user.

Figure 2D:
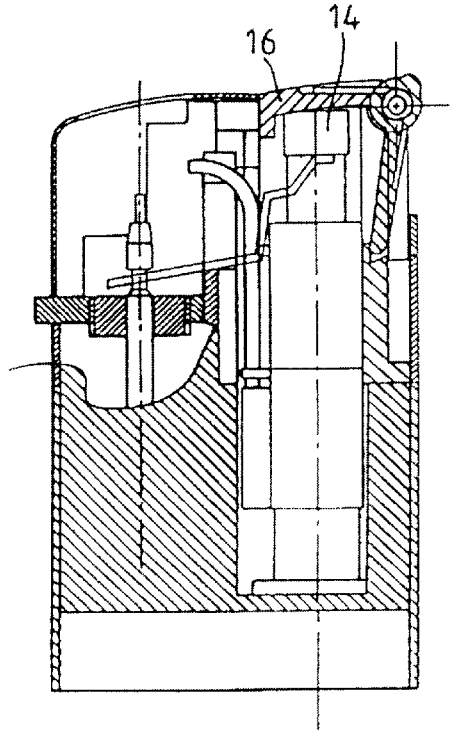
FIG. 2*d* is a view of the lighter in a position identical to the first position.

As shown in FIG. 2*d*, when the user stops applying a force F2 to cap 16 of the actuator, the actuator is returned to its initial rest position identical to that shown in FIG. 2*a* under the action of spring not shown in the figures and which has been compressed during the displacement of the actuator between FIGS. 2*b* and 2*c*.

During this upward motion, the active portion 46 of the safety member rises inside housing 37 and, when it exits there from, is then subject to the sole action of spring 48, thereby bringing it again against blocking ridge 34.

The safety mechanism thereby returned to its locked position wherein the flame generation device is blocked.

FIGS. 4*a* to 4*e* illustrate a second embodiment of a lighter according to the invention.

In this second embodiment, the lighter 60 also comprises a safety mechanism 32 with a safety member 64 cooperating with a blocking ridge 34 integral with said lighter.

It may be recalled that the elements described in reference to FIGS. 2A to 2*d*, with the exception of cap 16 and safety member 32 remain the same and preserve the same numerals as those of said figures.

In fact, in this second embodiment, only the structures of the cap and the safety member are modified in comparison with those of the first embodiment.

Figure 4B:
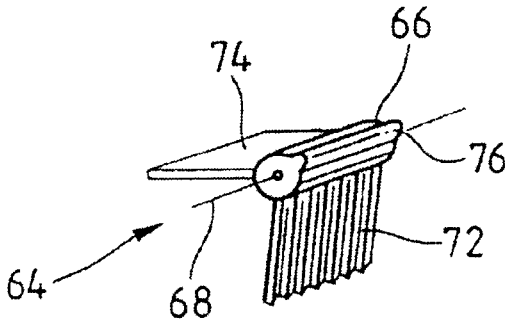
FIG. 4*b* is a perspective view of a safety member used in the lighter of FIG. 4*a*.

As shown in greater detail in FIG. 4*b*, safety member 64 comprises a bearing portion 66 whose function is similar to that of bearing portion 40 in FIG. 3*a* and which is arranged about a pivot axis 68.

This pivot axis connects safety member 64 to cap 70 in the same way as safety member 32 in FIGS. 3*a* to 3*c*.

Figure 4A:
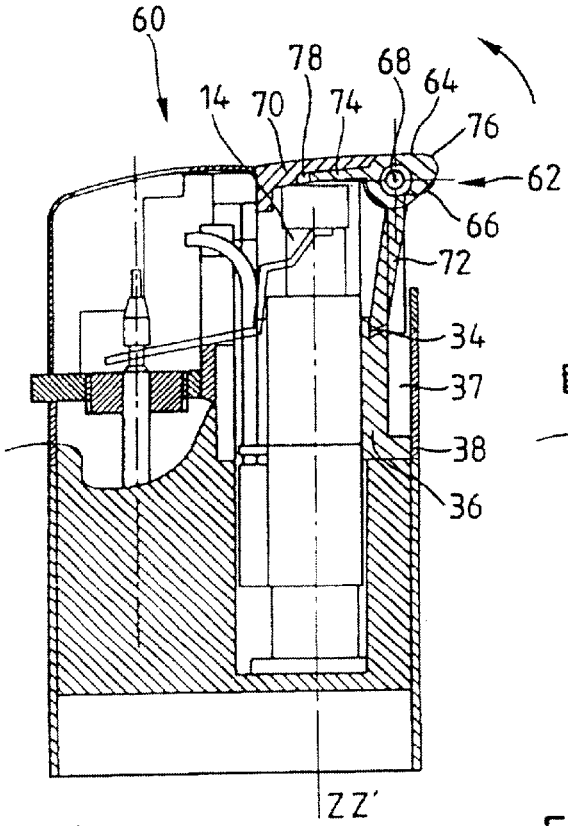
FIG. 4*a* is a view of a lighter according to a second embodiment of the invention, placed in a first position.

Safety member 64 also comprises two portions, one active, denoted 72, which comes against the blocking ridge 34 when the safety member is in the locked position, as shown in FIG. 4*a*, and an inactive portion 74, which is positioned between cap 70 of the actuator and the body of said actuator.

In a similar manner as described for safety member 32 shown in FIGS. 2 and 3, safety member 64 comprises a bearing portion 66 arranged about an axis 68, which forms a pivot axis for the safety member, the active portion 72 being in the form of a flange attached to said bearing portion 66, and the inactive portion 74 also being in the form of a flange attached to bearing portion 66.

Bearing portion 66 is grooved and also has an embossing 76 shown in FIG. 4*a*.

When the safety member is installed on the lighter, said safety member is fixed to the actuator via its pivot axis 68 in the same way as the fixing of safety member 32 to actuator 14 as shown in FIG. 3*c*.

Furthermore, the inactive portion 74 of the safety member is supportably maintained in a housing 78 arranged between cap 70 and the body of the actuator 14 (FIG. 4*a*), in a position preventing its pivoting.

It must be observed that the flange forming the inactive portion 74 of the safety member has a reduced thickness in comparison with the thickness of the bearing portion 66 and of the other flange 72.

This difference in thickness confers a degree of elasticity on safety member 34 enabling it to be deformed elastically, in a limited manner, during the pivoting motion about axis 68.

Note that when the safety member is installed on the lighter, the active portion 72 and inactive portion 74 naturally make an angle smaller than 90 degrees between each other.

In this position shown in FIG. 4*a*, safety mechanism 62 according to the invention is in the locked position and active portion 72 of the safety member is arranged against blocking ridge 34.

Figure 4C:
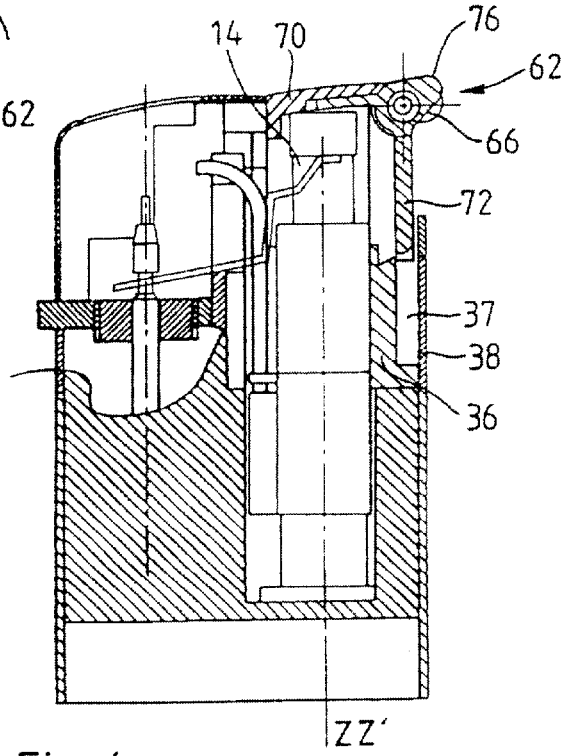
FIG. 4*c* is a view of the lighter of FIG. 4*a* in a second position.

In a similar manner to that described for the first embodiment, to go from the locked position of the safety mechanism, as shown in FIG. 4*a*, to the unlocked position thereof shown in FIG. 4*c*, the user of the lighter employs the embossing 76 to pivot safety member 64 about its axis 68, thereby bringing active portion 72 opposite housing 37.

As stated above in reference to FIGS. 2 and 3 of the first embodiment of the invention, the tilt to the horizontal and to axis ZZ' of the force applied by the user to the safety member at the end of the pivoting motion serves to easily sequence this movement with the displacement of the actuator along axis ZZ'.

Figure 4D:
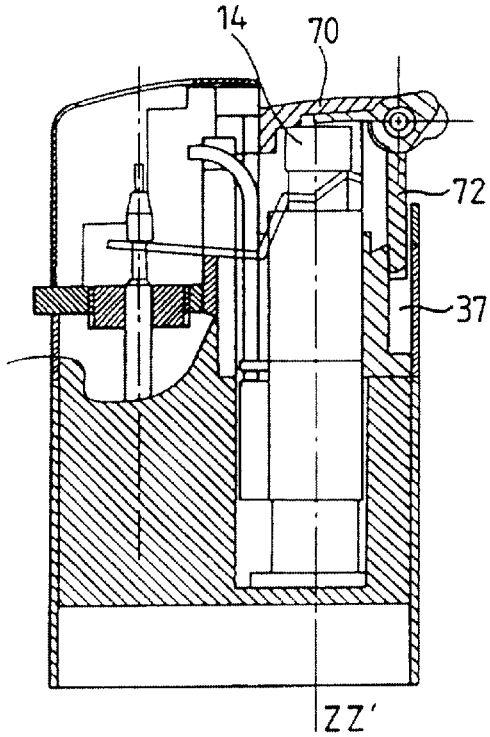
FIG. 4*d* is a view of the lighter of FIG. 4*a* in a third position.
Figure 4E:
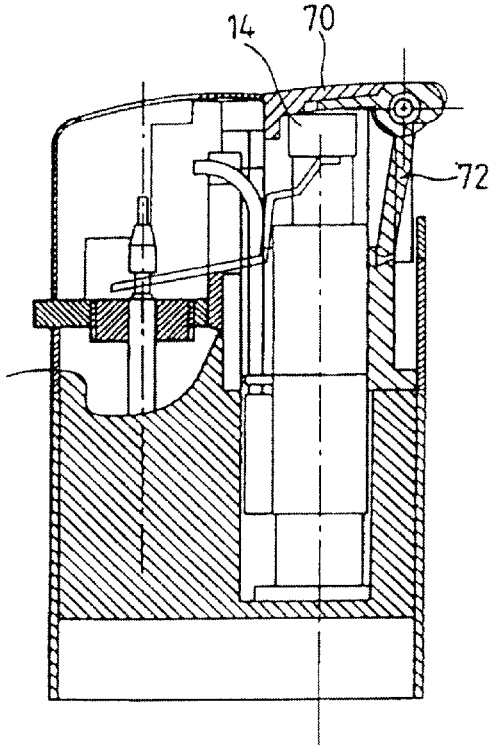
FIG. 4*e* is a view of the lighter in a position identical to the first position.

As shown in FIG. 4*d*, active portion 72 of the safety member engages in housing 37 as the user applies a vertical downward pressure to actuator 14.

When the pressure applied by the user to the actuator is released, the actuator rises under the action exerted by a spring not shown in the figures and, on returning to its rest position, shown in FIG. 4*c*, the safety member naturally returns to its locked position due to the elastic deformation it had undergone between the positions shown in FIGS. 4*a* and 4*c*.

FIGS. 5*a* to 5*d* show a third embodiment of the invention wherein the safety member forms one and the same member with the actuator.

All the elements forming part of the lighter described in the first two embodiments, but with the exception of the cap, the safety member and its blocking ridge, are not modified in this embodiment and, when mentioned, retain the same numerals as previously.

Figures 5A, 5B, 5C, 5D, 5E:
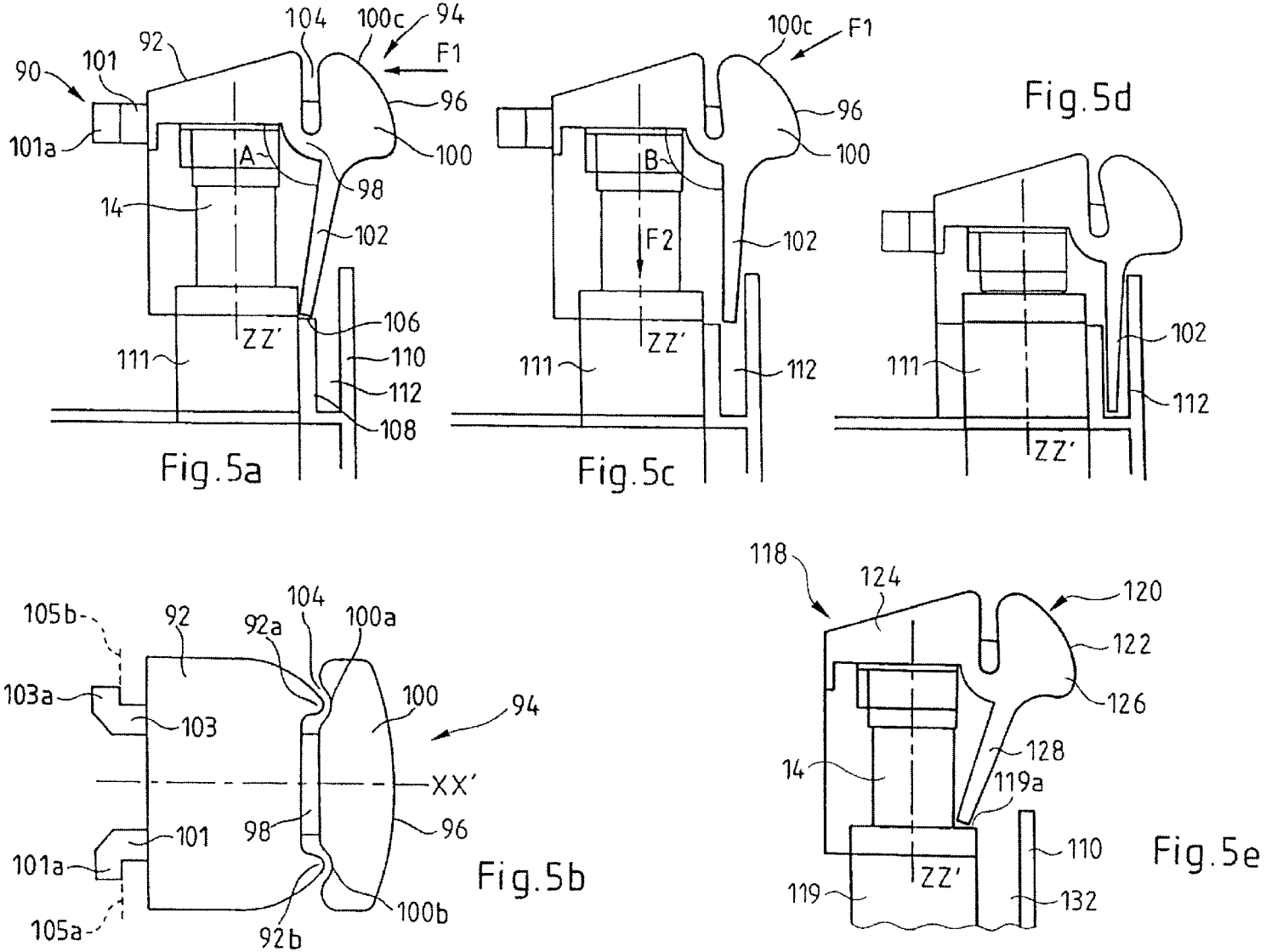
FIG. 5*a* is a partial schematic view of a lighter according to a third embodiment of the invention, placed in a first position.
FIG. 5*b* is a partial plan view of the lighter of FIG. 5*a*.
FIG. 5*c* is a view of the lighter of FIG. 5*a* in a second position.
FIG. 5*d* is a view of the lighter of FIG. 5*a* in a third position.
FIG. 5*e* is a side view of another embodiment of the invention.
Figure 6:
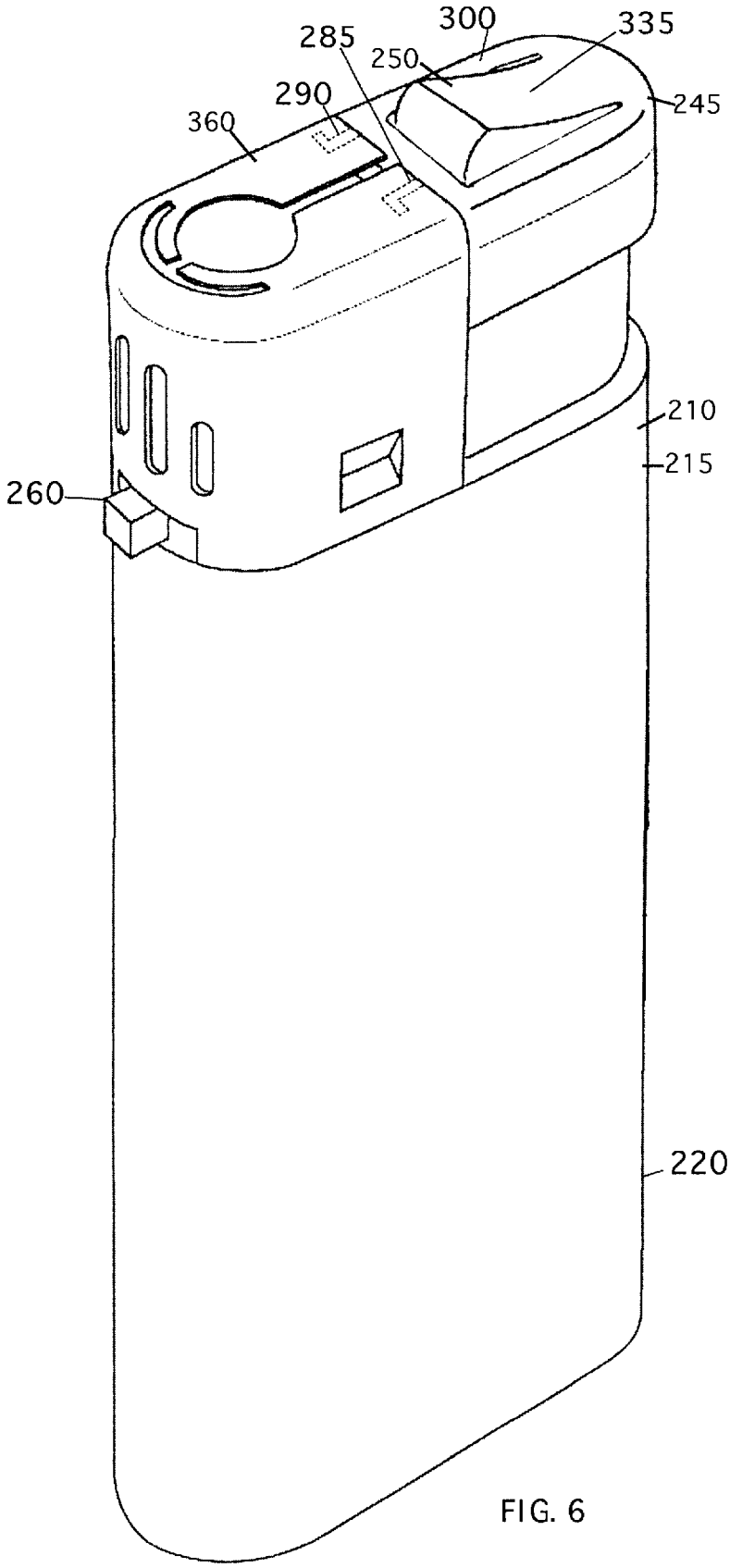
FIG. 6 shows a view of the new embodiment of the invention.
Figure 7:
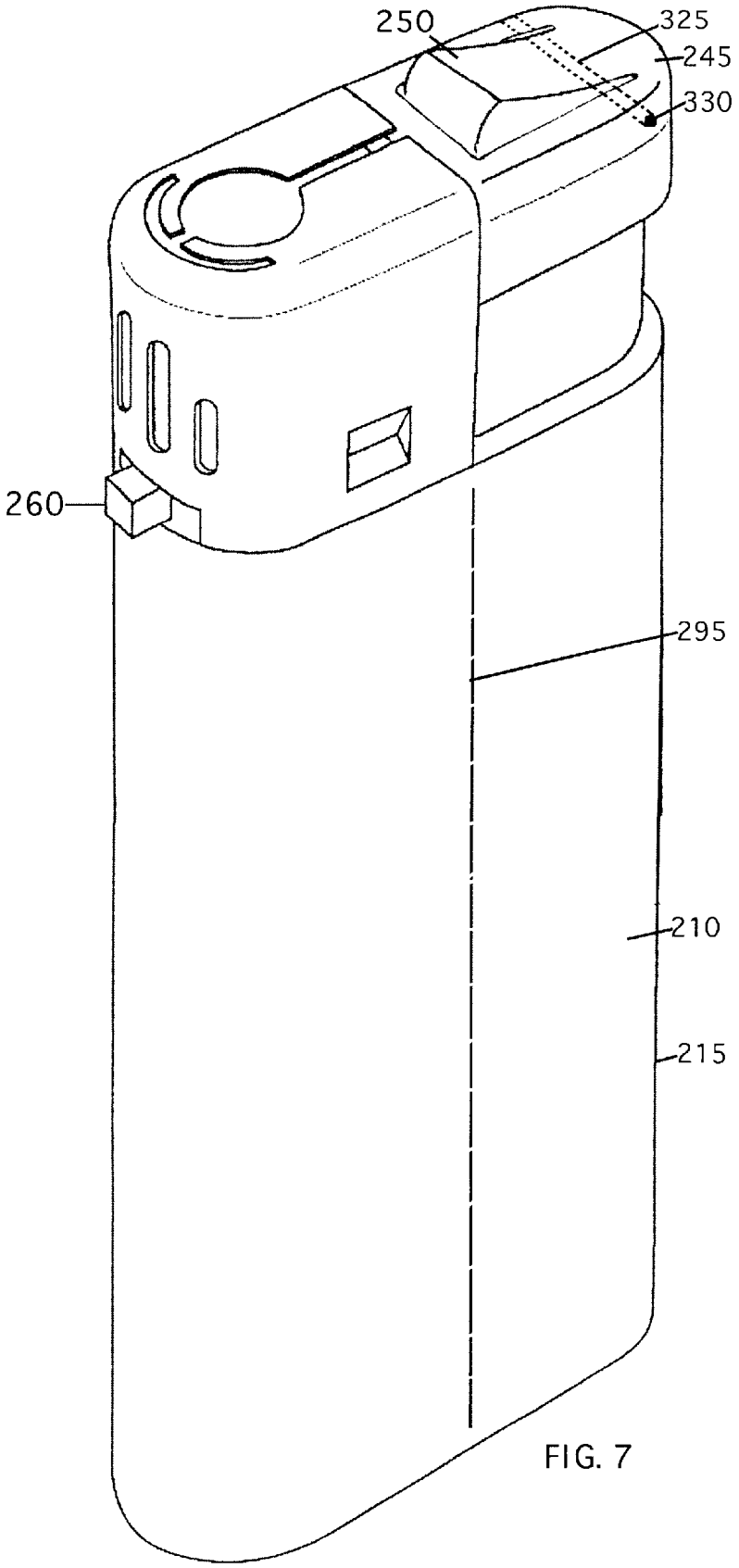
FIG. 7 shows a view of the embodiment of FIG. 6 with a pivoting attachment and a button axis.
Figure 8:
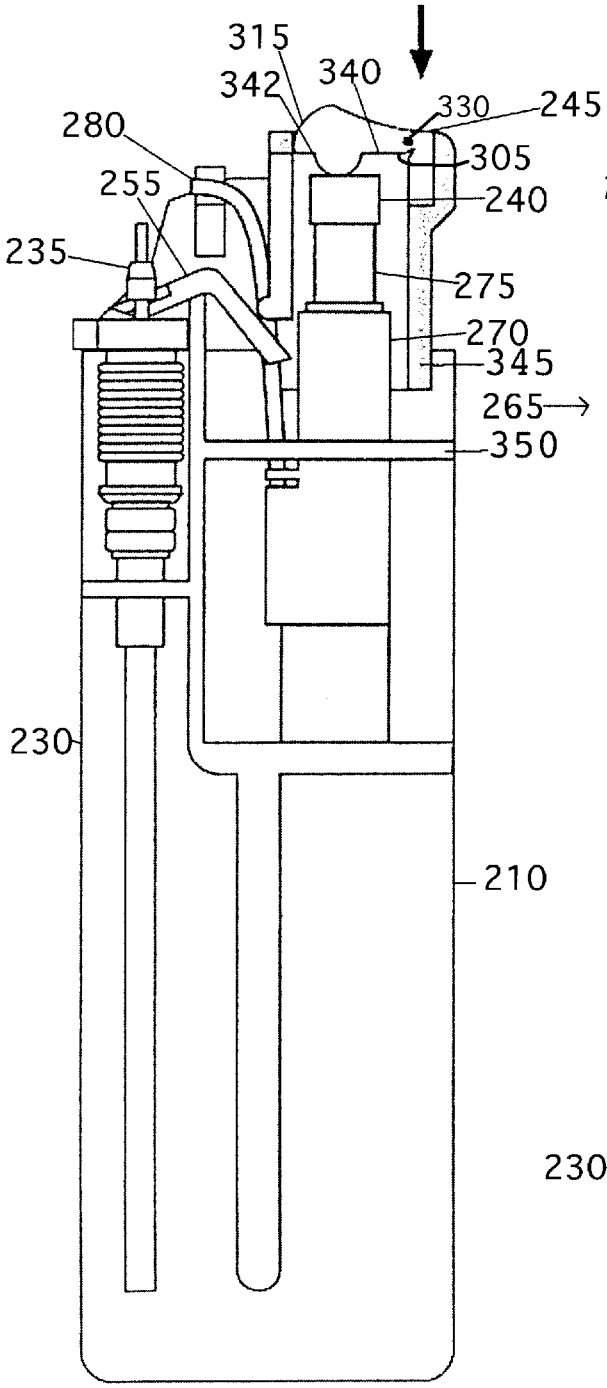
FIG. 8 shows a cross-sectional view of the lighter at rest.
Figure 9:
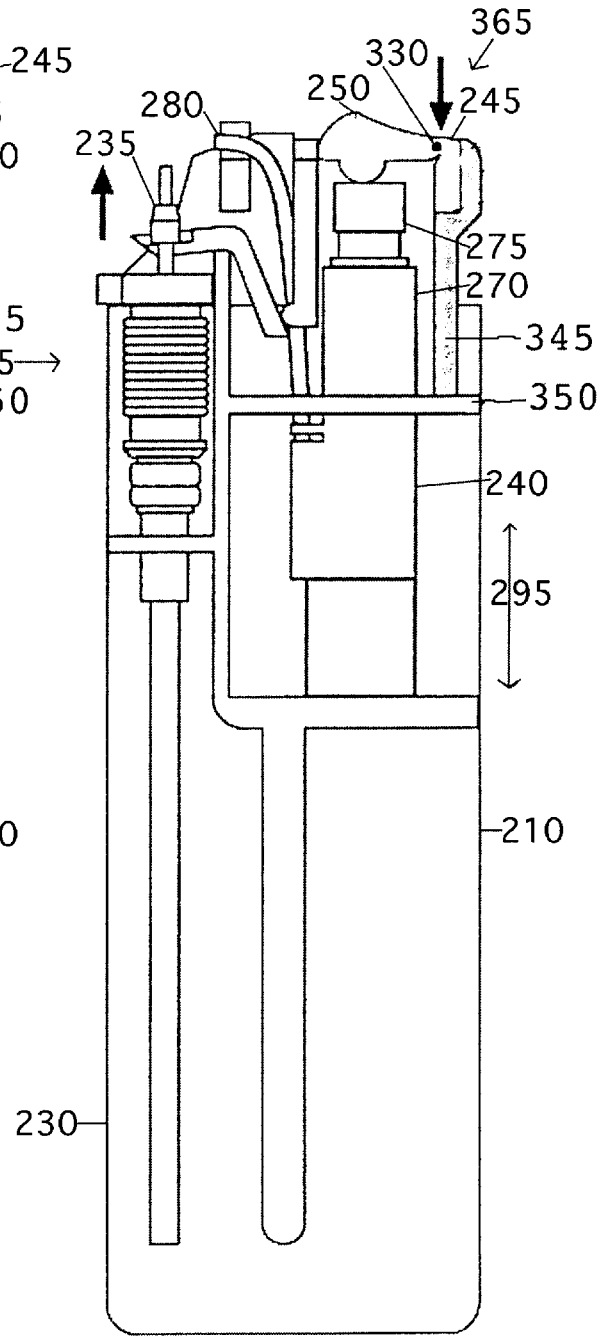
FIG. 9 shows another cross-sectional view of the lighter when the activation button is partially pressed down.
Figure 10:
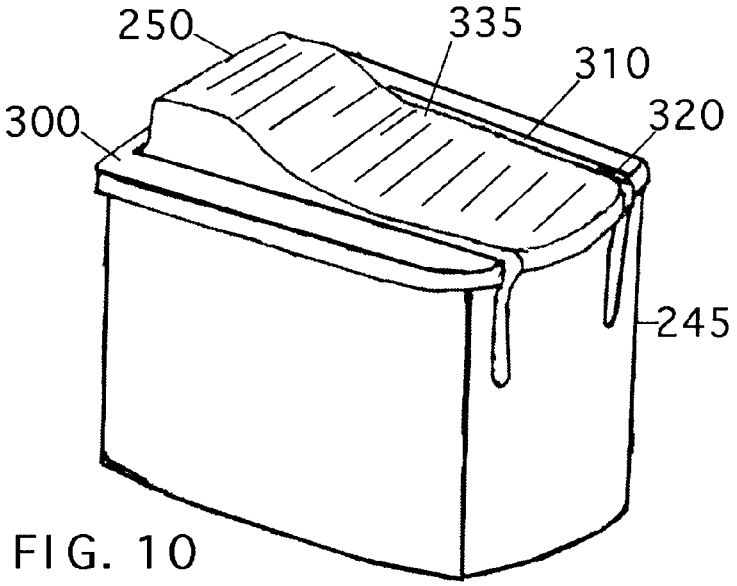
FIG. 10 shows a view of the activation button.
Figure 11:
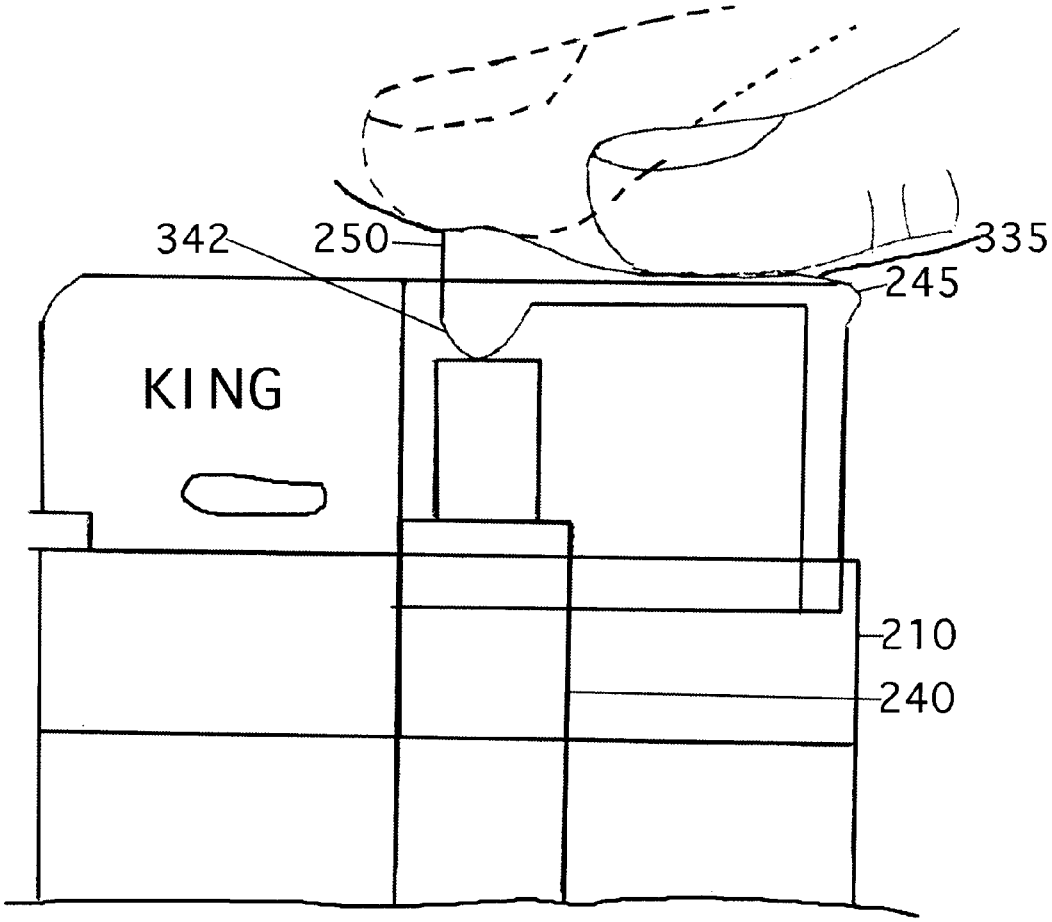
FIG. 11 shows a user's thumb on the activation button.

As partially shown in FIG. 5*a*, the lighter according to a third embodiment identified by the general reference denoted 90, comprises an actuator 14 identical to the one shown in FIGS. 2 and 4, but with the exception of cap 92 of actuator 14.

In this embodiment, the lighter comprises a safety mechanism 94 with a safety member 96 that is an integral part of the actuator in the sense that it is integral with the cap 92 via a curved arm 98.

Safety member 96 comprises two parts: an actuating head 100 and an active portion 102 extending from head 100 and from arm 98 and forming a flange.

The arm has a general U-shape whereof the concavity is turned towards actuating head 100.

This arm represents a sort of articulation of the safety member with respect to cap 92 of the actuator.

Actuating head 100*c* and flange 102 confer on safety member 96 a general T-shape where the head consists of said actuating head and which has a leg formed of said flange.

FIG. 5*b* shows the actuating head of the safety member in a plan view. Safety member 96 and cap 92 are connected by curved arm 98 whereof the thickness is reduced in comparison with that of the rest of the safety member to permit an elastic deformation of said arm during the pivoting motion of said safety member.

The pivoting motion takes place about an axis, which is placed at the level of the arm.

Also provided is a space 104 between actuating head 100 and cap 92 of the actuator to permit said actuating head to move in the direction of said cap, during the pivoting motion of the safety member towards its unlocked position.

However, it must be observed in FIG. 5*b* that cap 92, with respect to its median axis XX', has two portions forming a projection toward two concavities arranged in actuating head 100 and which are each symmetrical about the aforementioned median axis.

Space 104 is thus more particularly arranged between each projecting portion 92*a* (respectively 92*b*) and the corresponding concavity of actuating head 100*a* (respectively 10*b*).

Safety member 96 comprises a bearing portion 100*c* to which the user's force is applied, thereby permitting the safety member to make its pivoting motion.

In the representation thereof in the figures, the bearing portion is only one portion of actuating head 100.

In FIG. 5*a*, the safety member is naturally locked in the position wherein active portion 102 of said member is aligned with a blocking ridge 106 arranged in the upper portion of a wall 108 along which the actuator is disposed.

In this position, it is unnecessary for active portion 102 to be in contact with blocking ridge 106, said contact only occurring when the unintended user of the lighter applies a pressure to cap 92 to displace the actuator downward The lighter further comprises another wall 110 disposed opposite wall 108 and thereby arranging a housing 112 between them.

In a similar manner to that described for the first two embodiments of the invention, the pivoting motion of safety member 96 is obtained via a first tangential force applied by the intended user of the lighter in a direction forming a positive or zero angle with the horizontal, as shown by the arrow in FIG. 5*c*.

The user applies this fore to the bearing portion 100*c* of the safety member.

When the user has applied this force until contact is obtained between the projecting portions 92*a* and 92*b* and the respective concavities 100*a* and 100*b*, any subsequent deformation is made impossible due to the disappearance of the space 104 between cap 92 and actuating head 100.

The user thereby knows that the safety mechanism is in the unlocked position.

In this position shown in FIG. 5*c*, the user is naturally guided in the following movement, which consists in pressing on cap 92 along axis ZZ' to displace the actuator downward, due to the fact that the direction of the first force applied by the user at the end of the pivoting motion makes an angle greater than 90° with the direction of axis ZZ'.

It must be observed that the cap has a non-uniform thickness and which is greater in its part disposed opposite the actuating head, thereby forming a tilted place as shown in the figures, to receive the user's finger.

Thus, when the safety mechanism is in the unlocked position (FIG. 5*c*) and the user applies a vertical force to lower the actuator, the active portion 102 of safety member 96 is arranged facing housing 112, thereby enabling the safety member to engage therein with the downward movement of the actuator, to stop at the end of housing 112 when the actuator is in its ready position (FIG. 5*d*).

The return to the rest position of the actuator and to the locked position of the safety mechanism naturally takes place, for the user, by releasing the pressure applied to cap 92.

The lighter thereby returns to the position shown in FIG. 5*a*.

Note that it is advantageous in the three embodiments described above to fix or to consolidate the safety member of the actuator cap and not of the actuator body, in order to simplify the manufacture of the lighter of the invention.

In fact, with a mechanism as described in U.S. Pat. No. 5,833,448, the entire design of the actuator must be reviewed to install such a safety mechanism, complicating and thereby increasing the production cost of the lighter.

New Embodiment:

A general description of the piezoelectric lighter (210) will be provided before presenting a detailed description of the safety feature that constitutes the invention.

The primary elements of the applicant's lighter (210) include a lighter housing or body (215), a fuel or gas tank (230) with a gas release valve (235), said gas tank (230) substantially occupying the lighter housing (215), a piezo unit (240), and an activation button (245), which has a flipper (250).

The lighter housing or body (215) of the lighter (210) can have a variety of different shapes, including an elongated shape or a cylindrical shape with a elliptical cross section. A fuel tank (230) occupies substantially the lighter housing (215) and contains conventional fuel, such as butane. Protruding from the top side of the fuel tank (230) is a fuel or gas release valve (235), which is spring loaded so that it is normally urged to the closed position. To open the valve (235), the user applies downward pressure on the activation button (245); this causes the operation of a fuel or gas release lever (255) to open the gas release valve (235). The fuel or gas release lever (255) translates the motion of the activation button (245) to open the gas release valve (235). The lighter (210) can also be equipped with a flame-adjusting wheel (260), which can be turned to adjust the amount of fuel released and the height of the resultant flame.

The next element of the lighter (210) is a piezo or piezoelectric unit (240). This piezo unit (240) is fitted within the top portion (265) of the fuel tank (230) and protrudes from said top portion, opposite the fuel-discharge valve (235). The piezoelectric unit (240) has a lower section (270), which constitutes the piezoelectric housing, and an upper section (275), which constitutes the sliding section. Operation of the piezoelectric unit (240) creates an electric discharge that is carried to the fuel-discharge valve (235) via an electric circuit connector (280). The electric circuit connector (280) is generally made of material able to conduct electrical charge. When the piezo unit (240) is activated, the discharge ignites gas released from the gas release valve (235).

One of the primary elements of the child-resistant mechanism is the activation button (245). The activation button (245) is mounted on an end of the lighter housing (215) and is capable of being depressed toward said piezo unit (240) in the lighter body (215). The activation button (245) can also engage the gas release lever (255). The activation button (245) can also have integrated guide arms (285, 290) that allow the activation button (245) to slide up and down along the longitudinal axis (295) of, and relative to, the lighter housing or body (215). The activation button (245) has a first surface (300) and a second surface (305). The first surface (300) of the activation button (245) has a generally flat surface and is engaged by the user's finger or thumb; however, it is amenable to different degrees of curvature or elevations.

The next primary element is a flipper (250). The first surface (300) of the activation button forms an area or a space (310) for receiving the flipper (250). This space (310) can be surrounded by the first surface (300) of the activation button (245). However, this space (310) for the flipper (250) on the activation button (245) can vary in size, and does not need to be completely bounded by the activation button (245). The flipper (250) has a first end (315) and a second end (320). The flipper (250) can be pivotally secured or integrally attached to the activation button (245) about a button axis (325). This button axis (325) is substantially perpendicular to the longitudinal axis (295) of the lighter body (215). The flipper is positioned so as to be capable of descending through said space (310) in said activation button (245) to engage said piezo unit (240).

The second end (320) of the flipper (250) is attached to the activation button (245) with any kind of pivoting attachment (330), such as a screw, hinge or small bolt.

In addition, the flipper (250) can also be integrally formed with the activation button (245). Because of the elastic nature of material used for the activation button (245), the flipper (250) is capable of moving independently of the activation button (245) and of descending through said space (310) in said activation button (245) to engage said piezo unit (240).

The flipper (250) has a first flipper surface (335), which is engaged by the user's finger, and a second flipper surface (340), which contacts the piezo unit (240), specifically the upper (275) or sliding section of the piezoelectric unit (240). The second flipper surface (340) can also have multiple surfaces, elevations, and degrees of curvatures, including a piezo contact surface (342) that engages or contacts the upper or sliding section (275) of the piezoelectric unit (240). Both the first (335) and second (340) flipper surfaces are amenable to different elevations or degrees of curvature.

The flipper (250) can be a variety of different shapes and sizes and made of a variety of materials, including rubber, plastic, and some alloy metals. If the flipper (250) is integrally attached or formed to the activation button (245), the flipper (250) is preferably made with a material with elastic or rebounding properties. Material with elastic or rebounding properties help the flipper (250) to move independently of the activation button (245). Also, when the activation button's stopper (345) contacts the ledge (350) of the lighter housing (215), the flipper (250) is able to move independently so that the piezo unit (240) can be activated.

Also, attached to the activation button (245) is the stopper (345). The stopper (345) extends from the activation button (245) in a direction that is parallel to the longitudinal axis (295) of the lighter (210). The stopper (345) functions by engaging and limiting the downward movement of the activation button (245). When the activation button (245) is depressed alone, the stopper (345) engages and contacts a ledge (350), which projects inward from the lighter body (215) and in a direction that is generally perpendicular to the longitudinal axis (295) of the lighter. Thus, the activation button (245) cannot travel any further once the stopper engages the ledge (350).

Finally, the lighter (210) is equipped with a windscreen (360) which provides wind protection so that a flame is more easily generated, and less easily extinguished by wind. Moreover, the windscreen (360) holds the top portion of lighter (365) together by engaging the activation button (245) and the top portion of the lighter housing (215).

In the preferred embodiment, the primary elements of the safety-related invention described herein, as well as the interaction between these and the other, more conventional, elements of the lighter can be further defined as follows. The activation button (245) is mounted on an end of the lighter body (215). The activation button can also be slidably secured between the lighter housing (215) and the windscreen (360). In addition, there can also be guide arms (285, 290), which can be integrally formed from the activation button (245); these guide arms (285, 290) can allow the activation button (245) to slidably engage the lighter housing in a direction that is parallel to the longitudinal axis (295) of the lighter (210). Depressing the activation button (245) results in activation of the fuel-discharge valve (235) through the fuel-release lever (255).

Figure 12:
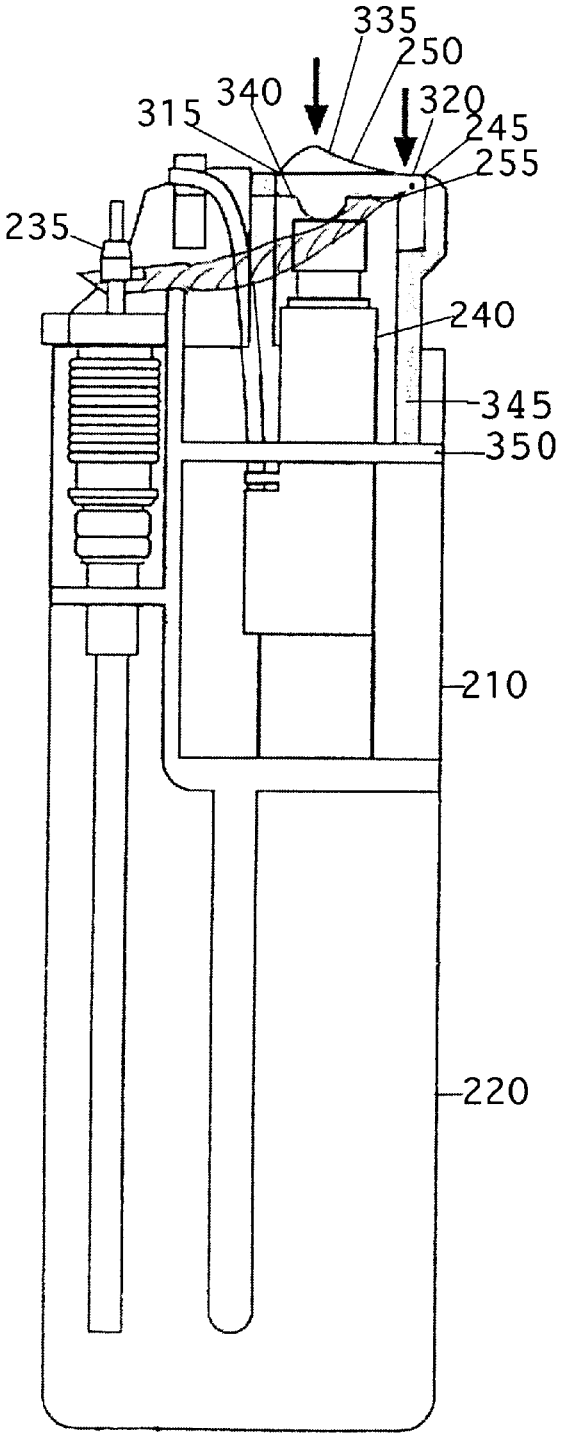
FIG. 12 shows a cross-section view of another lighter when the activation button is partially pressed down.

The stopper (345) and the ledge (350) limit the downward motion of the activation button (245). The stopper (345) is a projection that extends from the activation button (245) in a direction that is downward and that is parallel to the longitudinal axis (295) of the lighter (210). In the preferred embodiment, as the activation button (245) is depressed, the stopper (345) contacts the ledge (350) of the lighter body (215) as shown in FIG. 12.

Figure 13:
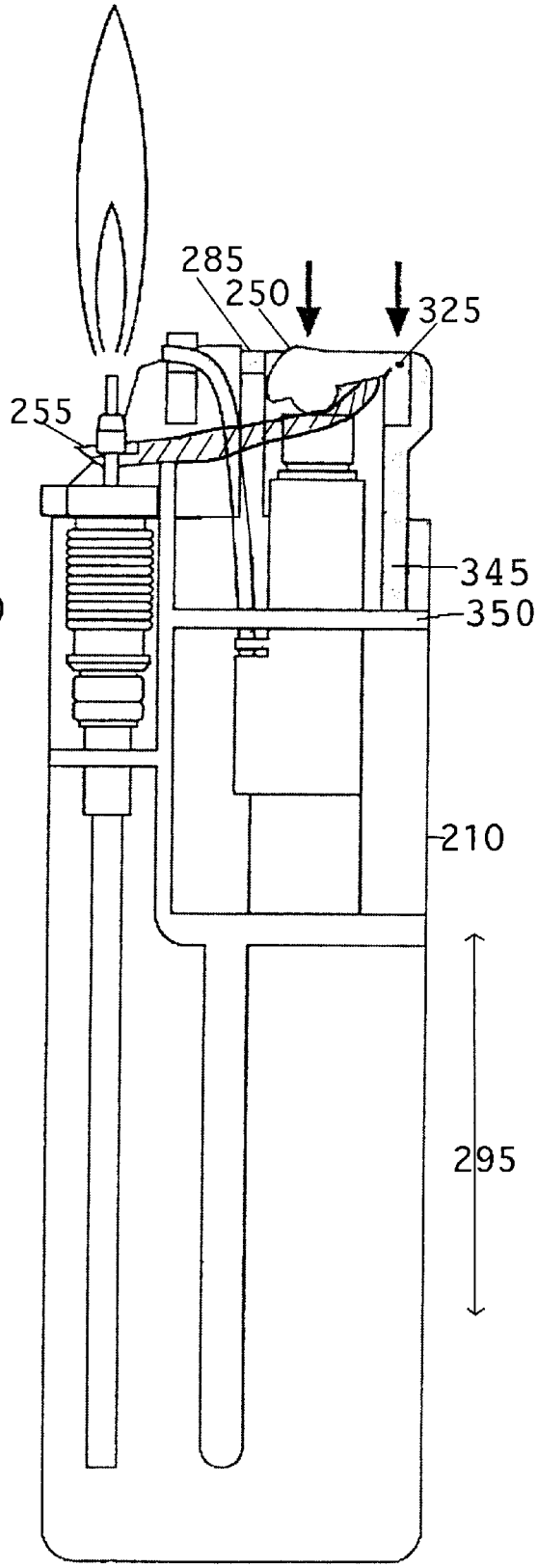
FIG. 13 shows a cross-sectional view of the lighter of FIG. 12 when the flipper is pressed downward and past the level of the activation button to activate the piezo-electric unit.

Activation of the piezoelectric unit (240) is achieved via operation of both the activation button (245) and then the continued pressing down on the flipper (250) as shown in FIG. 13. The flipper (250) is within a space (310) of the activation button (245) and rotates around a button axis (325). Because the flipper (250) is movably attached to the activation button (245), the user is able to engage the sliding section (275) of the piezo unit (240), even after the activation button (245) is stopped by the ledge (350). Thus, to ignite the gas emitting from the lighter, the user needs to depress the activation button (245) and to rotate the flipper (250) about said button axis (325) to cause said valve (235) to open and said piezo unit (240) to generate a spark.

Although, in the diagrams depicting the preferred embodiment, the relative surface area of the flipper (250) is shown to be approximately between one-third and one-half of that of the first surface (300) of the activation button (245), this is not a requirement of the present invention. The smaller the cross-sectional area of the flipper (250), the more difficult the operation of the lighter (210) for young children. As such, the relative sizes of the first flipper surface (335) and first surface of the activation button (300) can be changed as dictated by safety requirements.

Also, in the preferred embodiment, the space (310) for the flipper (250) is located near the middle of the activation button (245). The invention described herein is not limited to this feature of the embodiment either. For example, the space (310) and the activation button (245) can be located much closer to the windscreen (360). This would not diminish from the effectiveness of the safety feature or the ease of use of the lighter (210) for adult operators.

Operation of the New Embodiment:

FIGS. 8–9 and 11–13 show the operation of the preferred embodiment. The user operates the lighter (210) by depressing the first flipper surface (335) simultaneously with the activation button (245). Initially, the flipper (250) and the activation button (245) travel a distance Y down the longitudinal axis (295) of the lighter (210). The activation button (245) will continue down the longitudinal axis (295) of the lighter (210) until the stopper (345) contacts the ledge (350) of the lighter body (215).

Even though the downward progress of the activation button is stopped, the user continues to apply downward pressure on the flipper (250) and to rotate the flipper (250) about the button axis (325) to activate the piezo unit. The second flipper surface (340) contacts and compresses the upper section (275) of the piezo unit (240) such that a spark is generated. Also, when the activation button (245) is depressed, the fuel or gas lever (255) is also depressed such that the gas lever (250) opens the gas release valve (235) and releases some fuel. With combination of the released gas and the generation of a spark, a flame is produced.

While the range of motion of the activation button alone may be sufficient to open the fuel-discharge valve (235) via engagement of the fuel-release lever (255) by the activation button (245), it is not enough to activate the piezoelectric unit (240). To achieve such activation, the user continues to depress the flipper (250) beyond the vertical distance traveled by the activation button (245). This requires that the user have sufficient pulp on his/her finger to continue depressing the flipper (250), even after the stopper (345) has prevented the downward movement of the activation button (245). This is a requirement that is rarely met in young children.

When the user releases the flipper (250), the flipper (250) returns to its original position by the pivoting attachment or the elastic nature of the materials of the flipper (250) and the activation button (245). Also, as the sliding section (275) of the piezoelectric unit (240) moves upward, the activation button (245) and flipper (250) are returned to the original position.

It is noted that the invention disclosed herein is not to be limited by the embodiment shown in the figures and described in the description which is provided by way of example and not of limitation, but only in accordance with the scope of the appended claims.

I claim:

1. A child resistant lighter having an elongated lighter body containing a gas tank, a gas release valve, and piezo unit for igniting fuel when gas is released from said valve, the improvement comprising:

an activation button mounted on an end of said lighter body capable of being depressed toward said piezo unit in said lighter body;

said activation button having a first surface having a space formed therein for receiving a flipper;

said flipper pivotally secured to said activation button about a button axis that is substantially perpendicular to a longitudinal axis of said lighter body, and said flipper positioned so as to be capable of descending through said space in said activation button to engage said piezo unit; and whereby depression of said activation button and rotation of said flipper about said button axis causes said valve to open and said piezo unit to generate a spark resulting in ignition of said gas emitting from said lighter.

2. The child resistant lighter of claim 1 wherein said flipper is integrally formed with said activation button.

3. The child resistant lighter of claim 1 wherein said flipper has a first flipper surface and a second flipper surface;

said second flipper surface having a piezo contact surface whereby depression of said activation button and rotation of said flipper about said button axis causes said piezo contact surface to contact said piezo unit to generate a spark.

4. The child resistant lighter of claim 3 wherein said first flipper surface having a first elevation and a second elevation, said second elevation of the first flipper surface being engaged by the user's finger; and said second flipper surface having a first elevation and a second elevation; said second elevation of the second flipper surface engaging the piezo unit.

5. The child resistant lighter of claim 1 wherein said lighter body has a ledge projecting inward toward the longitudinal axis of the lighter body;

said activation button having a stopper extending downward from said activation button and parallel to the longitudinal axis of the lighter body; and whereby when said activation button is depressed, said stopper engages the ledge of the lighter body.

6. The child resistant lighter of claim 1 wherein said activation button comprises integrally formed guide arms for slidably engaging the lighter body.

* * * * *